US006508179B2

(12) United States Patent
Annis et al.

(10) Patent No.: US 6,508,179 B2
(45) Date of Patent: Jan. 21, 2003

(54) UNPOWERED TOY VEHICLE PLAY SET

(75) Inventors: Robert Annis, Parkridge, IL (US); Daniel Gleason, Brookfield, IL (US); Trevor J. Hayes, Medford, NJ (US); Robert A. Butkiewicz, Shamong, NJ (US); Julian R. Payne, Delran, NJ (US); Jeremy S. Robotham, Mt. Laurel, NJ (US); Francis Ponton, Marlton, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/071,359

(22) Filed: Feb. 8, 2002

(65) Prior Publication Data

US 2002/0108527 A1 Aug. 15, 2002

Related U.S. Application Data

(60) Provisional application No. 60/267,554, filed on Feb. 9, 2001.

(51) Int. Cl.[7] ..... A63G 21/00

(52) U.S. Cl. ..... 104/60; 104/53; 104/55; 104/67; 104/69; 238/10 A; 238/10 R; 463/69

(58) Field of Search ..... 104/53, 54, 55, 104/56, 58, 60, 63, 64, 67, 69, 79, 130.01, 130.05, 164; 238/10 R, 10 A; 446/168, 170, 171, 172, 174, 444, 445; 472/88, 85; 463/58, 62, 63, 69

(56) References Cited

U.S. PATENT DOCUMENTS

| | | | | | |
|---|---|---|---|---|---|
| RE17,312 | E | * | 6/1929 | Beck | 104/79 |
| 3,108,810 | A | * | 10/1963 | Wiley | 273/120 R |
| 3,384,991 | A | | 5/1968 | Einfalt | |
| 3,456,596 | A | * | 7/1969 | Cooper | 104/100 |
| 3,531,119 | A | * | 9/1970 | Bonanno | 104/60 |
| 3,541,724 | A | | 11/1970 | Einfalt | |
| 3,559,334 | A | | 2/1971 | Beny et al. | |
| 3,613,304 | A | | 10/1971 | Einfalt | |
| 3,665,636 | A | * | 5/1972 | Benson et al. | 463/69 |
| 3,860,237 | A | * | 1/1975 | Cooper et al. | 238/10 R |
| 4,051,624 | A | | 10/1977 | Ogawa | |
| 4,068,402 | A | | 1/1978 | Tanaka | |
| 4,140,276 | A | | 2/1979 | Halford | |
| 4,221,076 | A | | 9/1980 | Ozawa | |
| 4,227,693 | A | * | 10/1980 | Moe et al. | 446/444 |
| 4,249,773 | A | * | 2/1981 | Eddins et al. | 104/79 |
| 4,468,031 | A | | 8/1984 | Barlow et al. | |
| 4,550,910 | A | | 11/1985 | Goldfarb et al. | |
| 5,118,320 | A | | 6/1992 | Miller | |
| 5,452,893 | A | * | 9/1995 | Faulk et al. | 238/10 E |
| 5,683,298 | A | | 11/1997 | Jackson | |
| 5,709,581 | A | | 1/1998 | Rothbarth et al. | |
| 5,785,573 | A | | 7/1998 | Rothbarth et al. | |
| 5,908,343 | A | | 6/1999 | Rothbarth et al. | |
| 6,004,021 | A | | 12/1999 | Rothbarth | |
| 6,074,269 | A | | 6/2000 | Rothbarth et al. | |
| 6,083,078 | A | | 7/2000 | Yang | |
| 6,386,538 | B1 | * | 5/2002 | Mejia | 273/118 R |

* cited by examiner

*Primary Examiner*—Mark T. Le
(74) *Attorney, Agent, or Firm*—Akin Gump Strauss Hauer Feld, L.L.P.

(57) ABSTRACT

A play set for use with unpowered (e.g. 1/64 scale) toy vehicles having non-steerable, free rotating wheels includes a closed loop track with a conveyor that raises such unpowered toy vehicles from a lower end to an upper, elevated end and a driven, tilting roadway that randomly directs toy vehicles from the upper level to either of two track branches. At least part of each track branch can be opened to release a toy vehicle from the track. A merge track section joins together a lower level end of each of the two track branches and leads to the lower end of the conveyor. The upper end of the conveyor and the tilting roadway are simultaneously supported by a single and driven by a single motor.

8 Claims, 9 Drawing Sheets

UNPOWERED TOY VEHICLE PLAY SET

CROSS-REFERENCE TO RELATED APPLICATIONS

This application is related to U.S. Provisional Patent Application No. 60/267,554 filed Feb. 9, 2001.

BACKGROUND OF THE INVENTION

Present invention relates to a play set for use with small (e.g. 1/64 scale), unpowered, toy vehicles having non-steerable, free rotating wheels

BRIEF SUMMARY OF THE INVENTION

An unpowered toy vehicle play set includes a closed loop track comprising: a conveyor having a lower end and an upper end, a motor and a conveying element driven by the motor and configured to engage unpowered toy vehicles at the lower end and raise the engaged toy vehicles to the upper end; at least one tilting roadway along a portion of the closed loop track extending from the upper end to the lower end of the conveyor, the tilting roadway being mounted to tilt laterally side to side generally transversely to a direction of the closed loop track along the tilting roadway; and at least two track branches leading away and down from the at least one tilting roadway towards the lower end of the conveyor, the at least one tilting roadway being sufficiently proximal to the two track branches to direct unpowered toy vehicles coasting across the tilting roadway onto either of the at least two branches.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
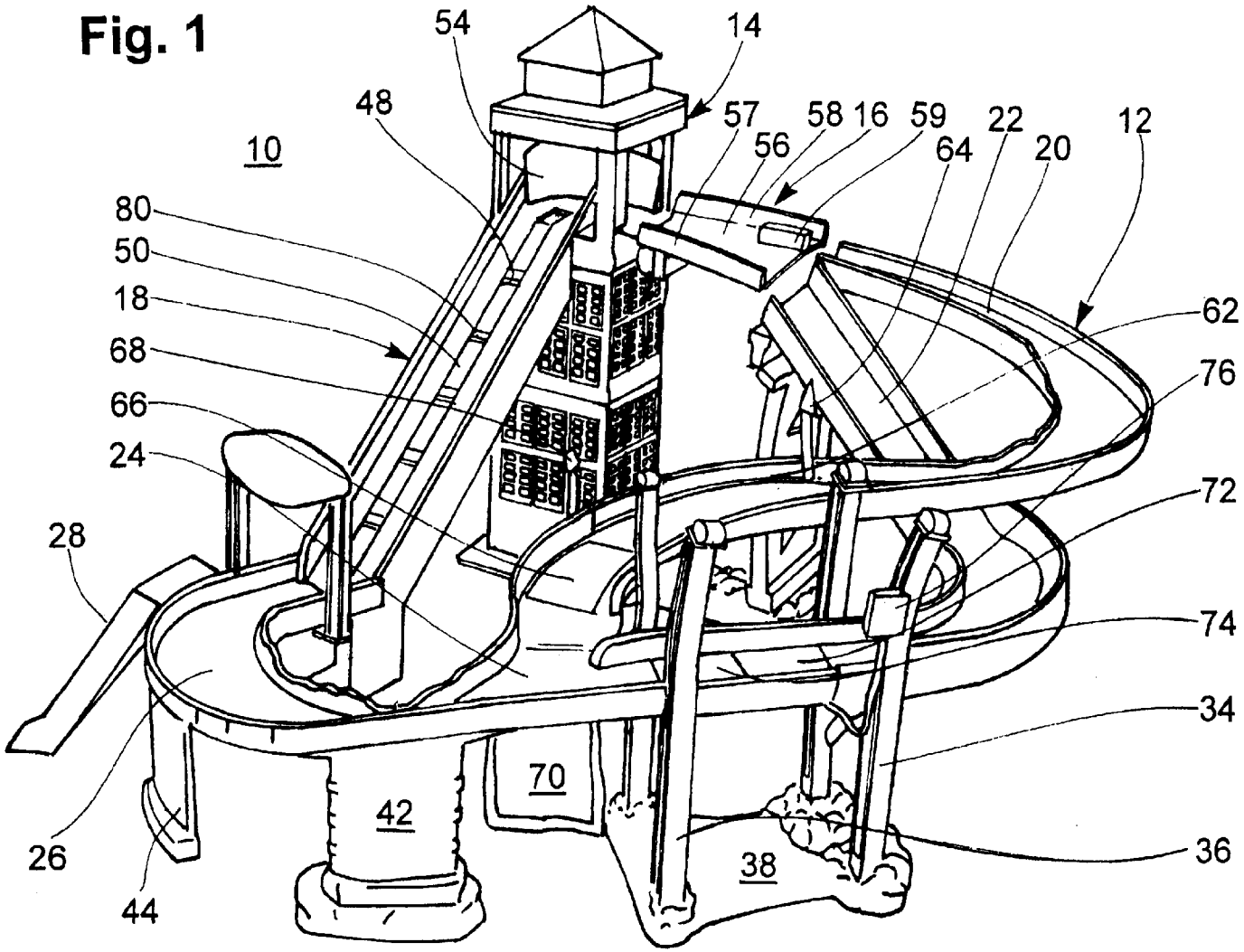
FIG. 1 is a prospective view of a conveyor equipped unpowered toy vehicle play set of the present invention.
Figure 2:
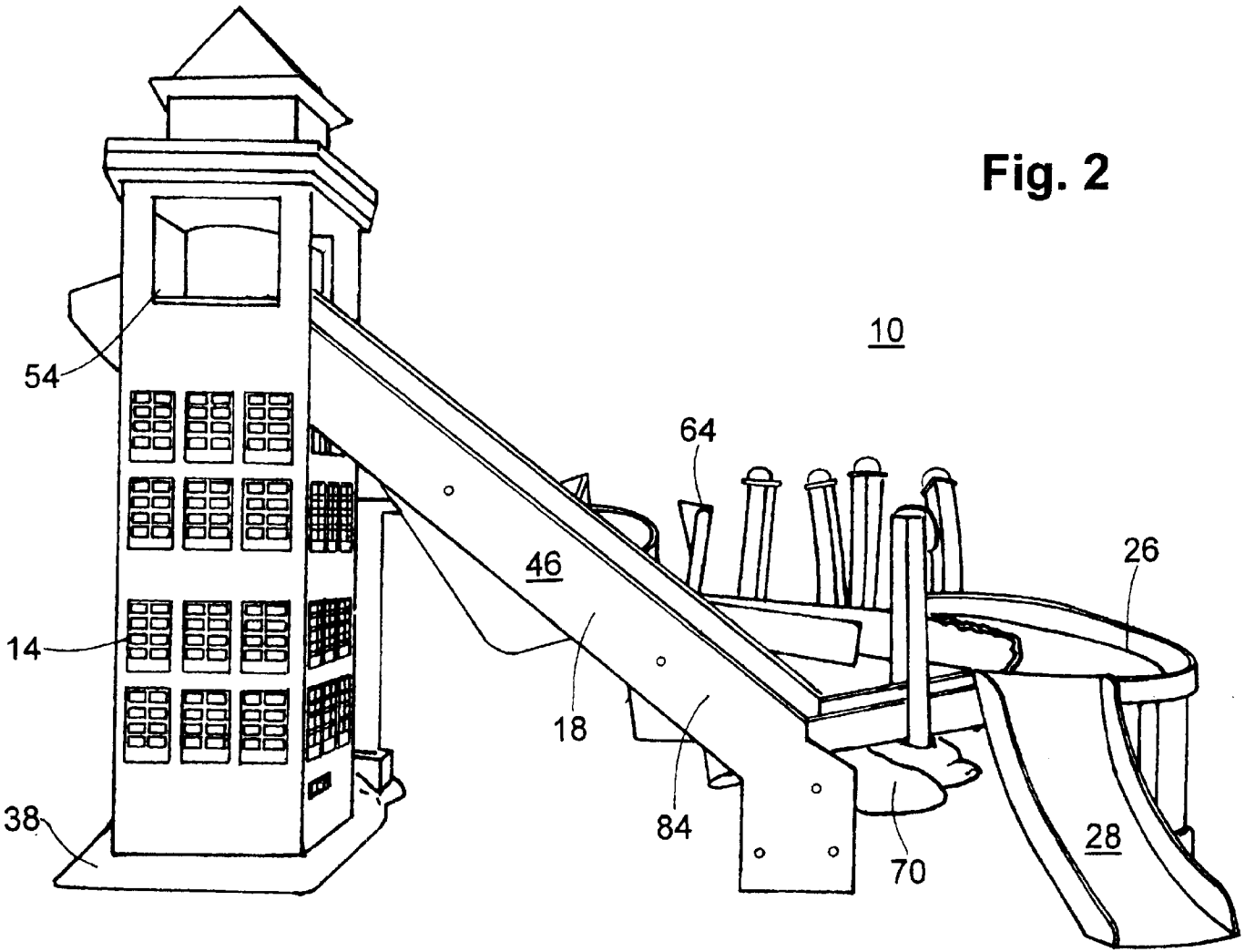
FIG. 2 is a first elevation showing the side of the conveyor connecting a lower end of a track portion of the device with a higher end at the top of a tower.
Figure 3:
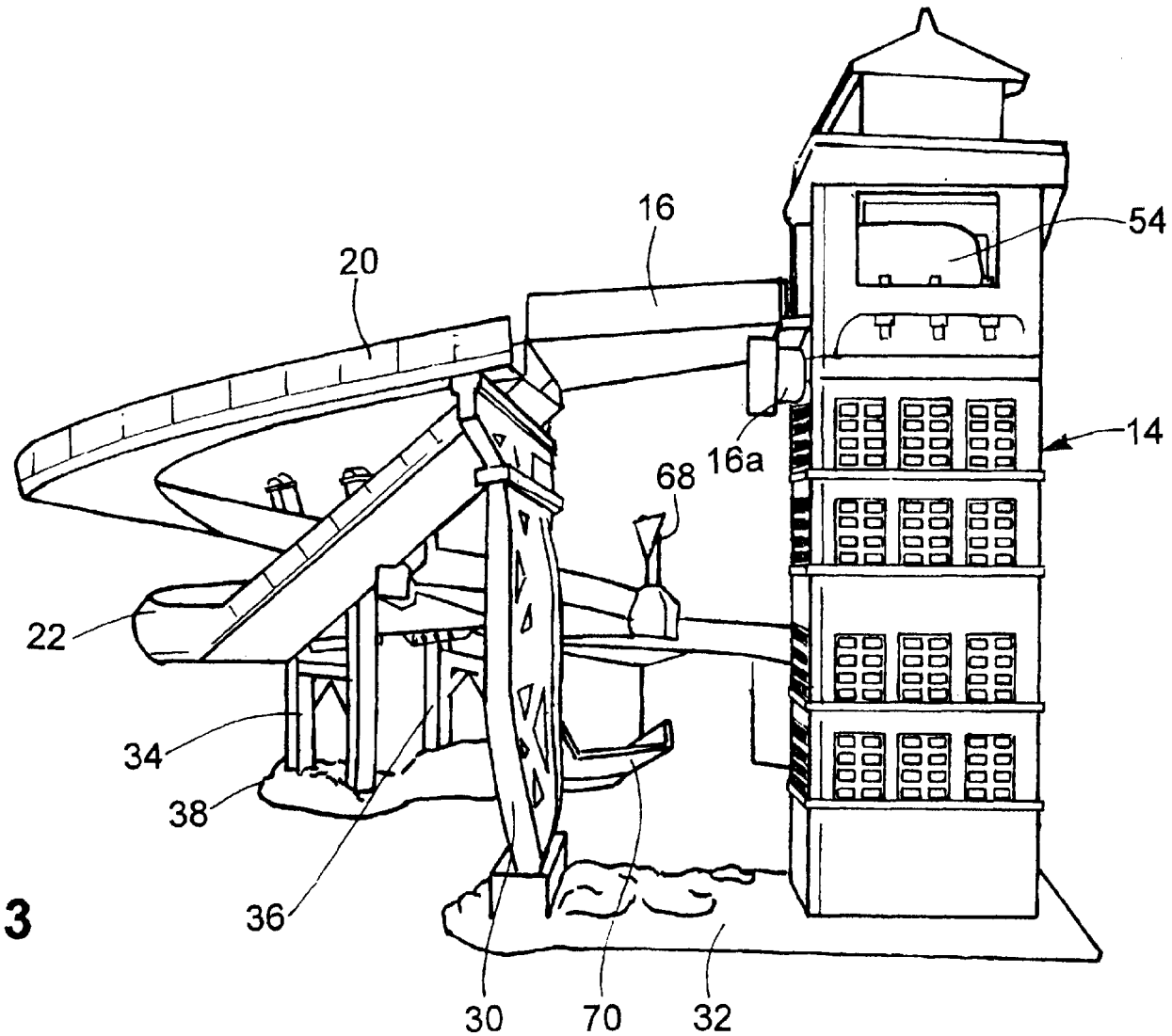
FIG. 3 is a second side elevation view rotated 90 degrees from the FIG. 2 view and depicting a lower side of a tilting roadway portion of the device.
Figure 4:
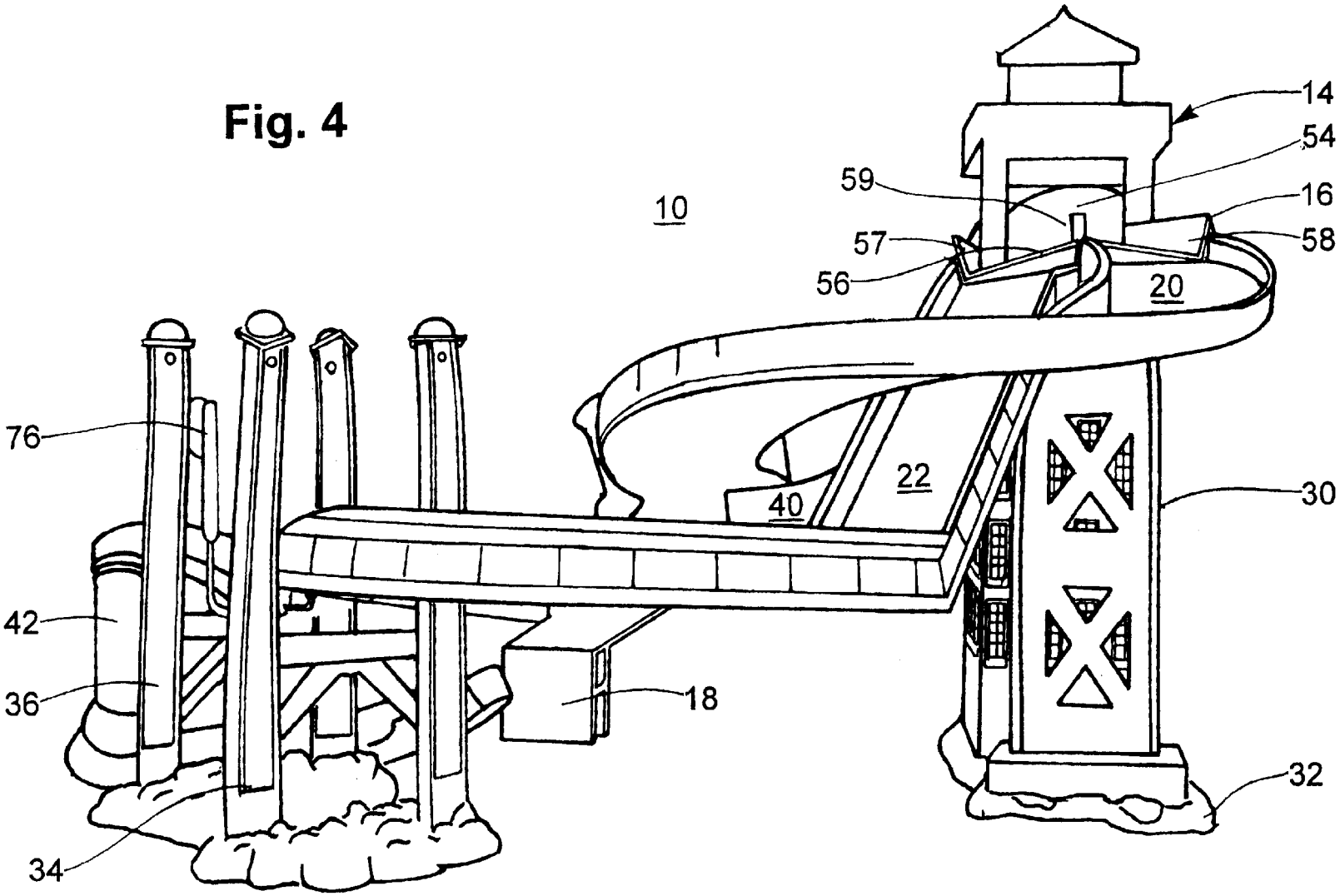
FIG. 4 is a third side elevation view rotated 90 degrees around the device from the view of FIG. 2.
Figure 5:
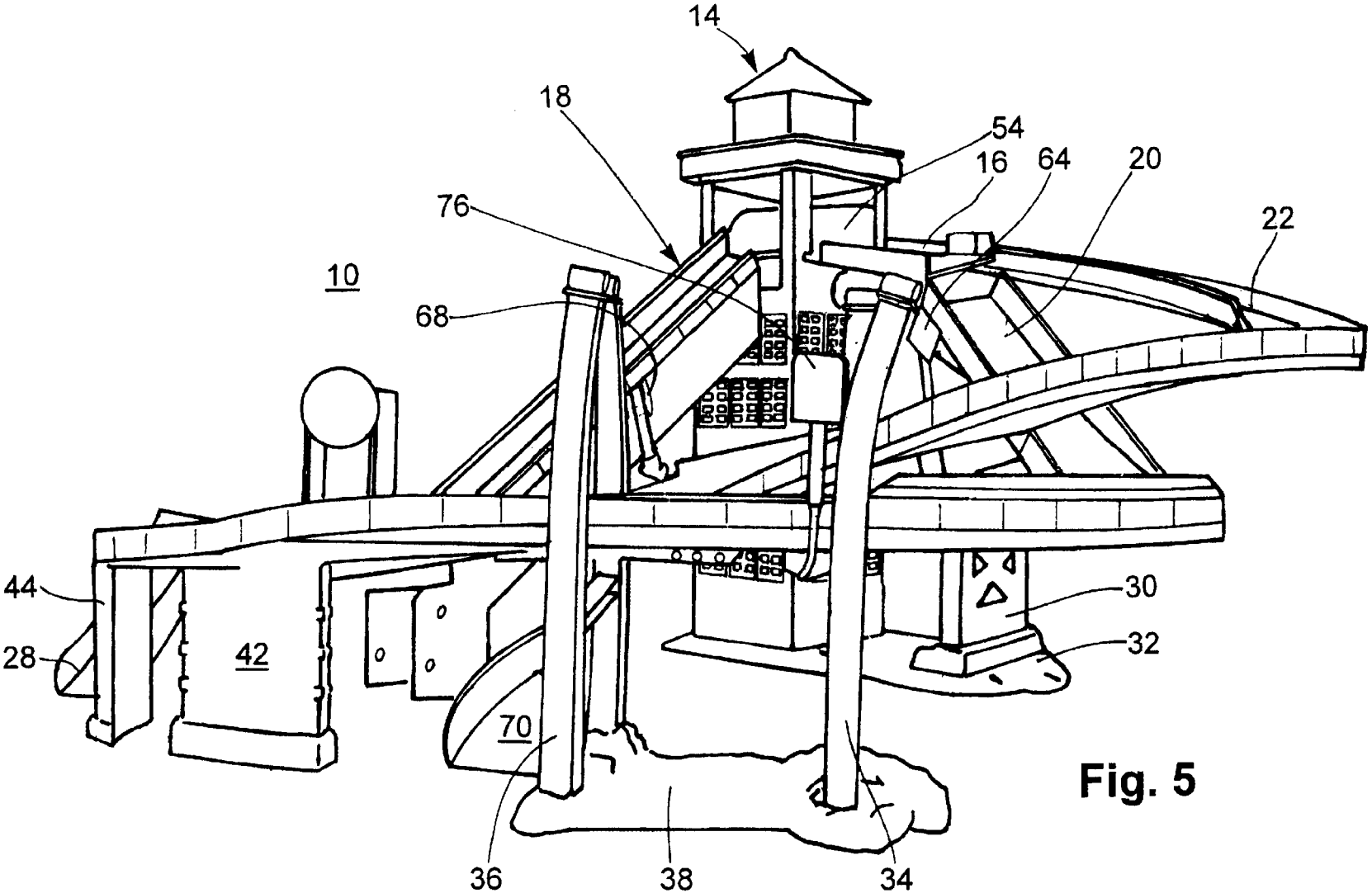
FIG. 5 is a fourth side elevation view rotated approximately 45 degrees from the view of FIG. 4 around the device.
Figure 6:
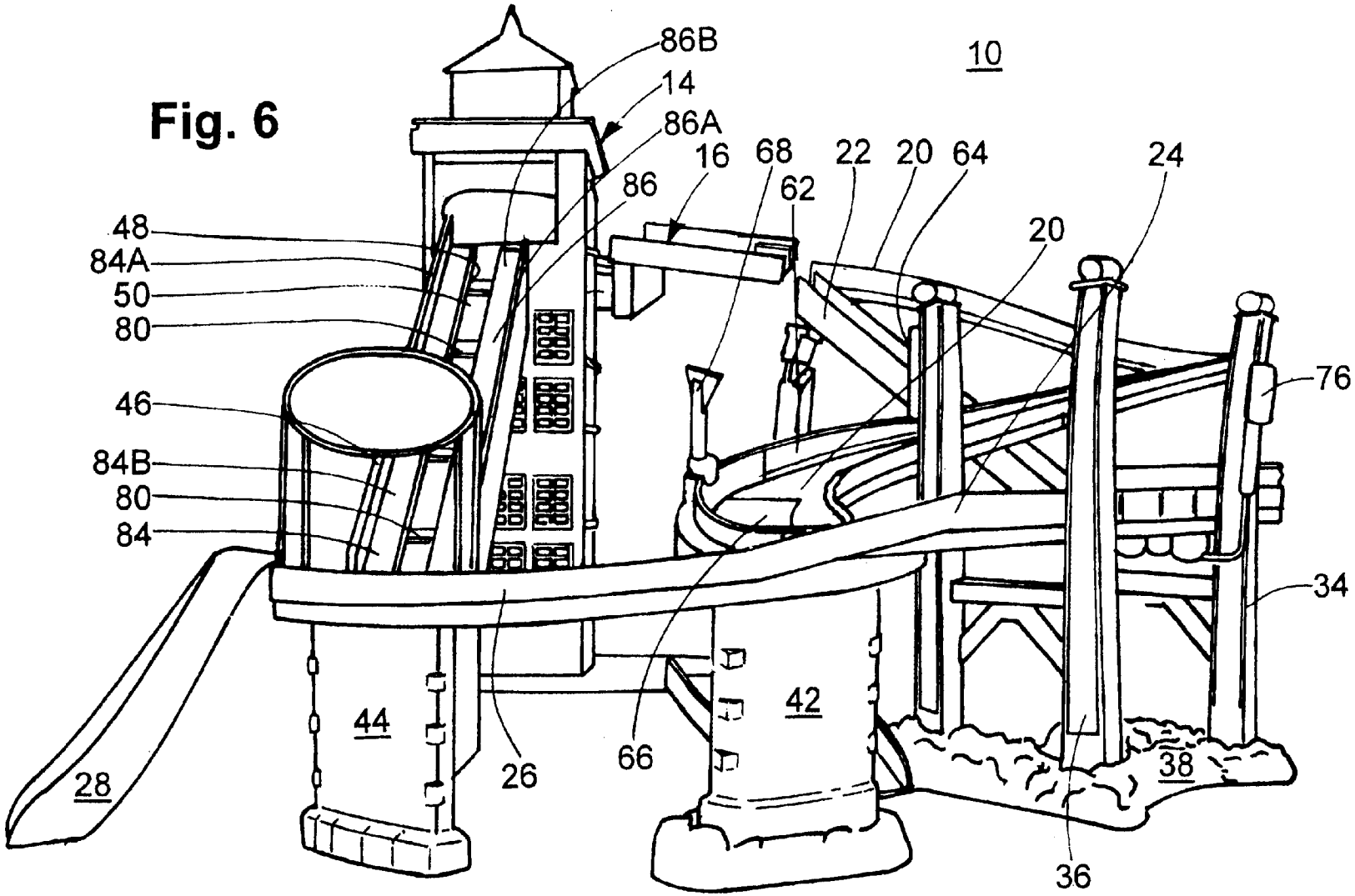
FIG. 6 is a fifth side elevation view rotated approximately 45 degrees from the view of FIG. 5.

In the various FIGS. 1–6, a unpowered (i.e. non-motorized) toy vehicle play set according to the present invention is indicated generally at 10. The play set 10 includes a closed loop track indicated generally at 12 formed by several interconnected track sections and other components. These other components include a tower 14, a tilting roadway 16 located on one side of the tower 14 and a conveyor 18 extending from a lower end 18A up to an upper end 18B on a side of the tower adjoining the tilting roadway 16. The interconnecting track sections define two track branches 20, 22 leading away and down from the tilting roadway 16, a merge portion indicated generally at 24 where the two branches 20, 22 meet and combine, and a single lane connection portion indicated generally at 26 extending from the merge portion to a lower level of the conveyor 18. The interconnected track sections further include an access ramp 28 which connects with the single lane connection portion 26. The set 10 further includes a double road support 30 (FIG. 2) interconnecting with and supporting upper ends of each of the two track branches 20 and 22 at the outer/lower/discharge end of the tilting roadway 16. As can be seen in FIG. 2, the double road support 30 connects with a base 32 extending from the bottom of tower 14. One track branch 20 is further supported by pairs of single road supports 34 and 36, which are preferably snapped into another base 38. The second branch 22 is supported by a member 40 (see FIG. 4) extending from the side of the first branch 20 where the second branch 22 passes over the first branch. Other supports 42 and 44 are provided beneath the merge portion 24 and single lane connection portion 26 to downwardly direct those portions to the lower end 18A of conveyor 18.

Conveyor 18 may have any of several configurations. The depicted conveyor 18 includes a stationary conveyor frame 46, which defines a portion of the track 12 with a center slot 48 through which an endless belt 50 moves. The belt 50 has a plurality of teeth 80 or other upwardly extending engagement members, preferably spaced at regularly spaced intervals, which engage with the toy vehicles previously described that are directed to the base of the conveyor 18 by the connection portion 26. The belt 50 pulls or pushes the unpowered toy vehicles of the type previously described to the top of the tower 14 where the vehicles are deposited upon a curving, descending ramp 54 which is located in the top floor of the tower 14 and which directs the vehicles by gravity onto the tilting roadway track section 16.

The tilting roadway 16 is configured by being supported on a cylindrical boss 16*a* to tilt or rock laterally side-to-side generally about a central longitudinal axis coincident with the central axis of the circular boss 16*a*. This rocking or tilting is generally transverse to a direction of the closed loop track 12 along the tilting roadway 16. The tilting roadway 16 has a base 56 forming a roadway portion of the track 12 and a pair of upright outer side walls 57, 58 forming opposing lateral retaining walls of the track 12. The base 56 widens as it extends away from the tower 14 and conveyor 16. A longitudinally extending, upright divider 59 is provided at the distal end of the roadway 16 to divide the distal end into two lanes. Preferably, one of the two lanes aligns generally with the upper end of the first branch 20 at one end of the rocking motion of the tilting roadway 16 while the other lane aligns with the entrance to the second branch 22 at the other end of the rocking motion of the tilting roadway 16. The remainder of the closed loop track 12 including the branches 20, 22, the merge portion 24, the connection portion 26 and the conveyor 18 are all provided with a base surface for supporting the toy vehicles and a pair retaining walls along the side edges of the support surface to direct and retain the toy vehicles along the closed loop track 12.

A plurality of hazards are preferably provided along the closed loop track 12 to enhance the play value of the play set 10. For example, the first branch 20 is, in top plan view, generally in the form of a reverse "S". A portion 62 of the outer retaining wall of the branch 20 at the second, lower curve, can be pivotally mounted with the remainder of the roadway of the branch 20 to move outwardly from the remainder of the roadway and permit cars coming down the branch 20 to exit the track 12 and crash into the surface supporting the play set 10. A lever 64 may be provided disguised as a road sign to permit manual movement of the portion 62 of the outer retaining wall. Another track section of the branch 20 can include a roadway surface formed by a door 66 pivotally mounted at its upper end so as to be pitched downwardly from the remainder roadway of the branch 20 to define another hidden hazard/exit from the closed loop track 12. A lever 68 coupled with the door 66 to permit manual movement of the door can be provided and also disguised as a road sign. If desired, a ramp 70 can be provided beneath door 66 positioned to receive any vehicles exiting the track 12 through door 66 to direct them away from the play set.

The second branch 22 can also be provided with a hazard in a form of a pair of adjoining roadway panels 72, 74 which are pivotally coupled at their far ends with the remainder of the structure of the branch 22 so as to pivot down creating a gap in the roadway along the branch 22. An actuating lever 76 may also be provided and disguised as a road sign for selective manual movement of the panels 72, 74. Vehicles that traverse the branches 20, 22 without leaving the track 12 enter the merge portion 24 where they are directed to the connection portion 26 and the bottom of the conveyor 18 for another loop of the track 12.

Figure 7:
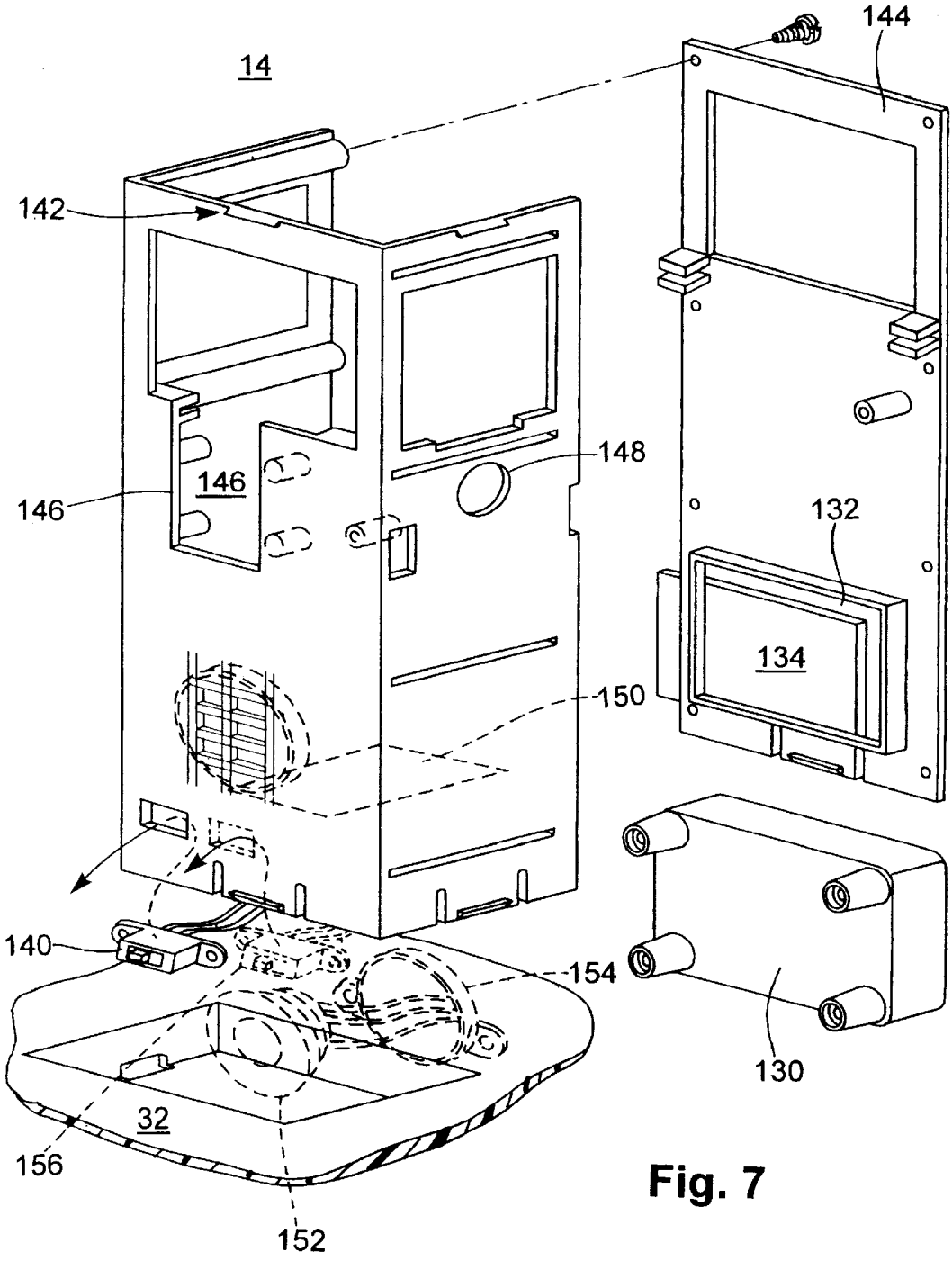
FIG. 7 is an exploded view of the tower.

FIG. 7 depicts the tower 14 in an exploded view with a separate top portion seen in the first six figures removed. The tower 14 can be formed in two pieces: a three sided or walled portion 142 and a separate fourth side or wall 144 which can be snapped or screwed together with portion 142. The fourth side is added after the internal elements are mounted in the three sided portion 142. This would include a coupling at the upper end 18*b* of the conveyor 18, the provision of a drive assembly, the mounting of an on/off switch 140 and any other components that may be provided. For example, a sound generation chip 150 indicated in phantom could be supplied with a speaker 152 suitable mounting means such as a retainer 154 and its own on/off switch 156 to generate sound effects while the device is operating. A power supply in the form of several batteries (not depicted) are contained in the battery box 130 which is mounted to the inner side of the fourth wall member which is further provided with an access opening 132 and battery box cover 134. A generally square opening 146 in the three walled member 142 receives the upper end 18*b* of the conveyor while circular opening 148 provides an exit for the outdrive to the tilting roadway 16.

Figure 8:
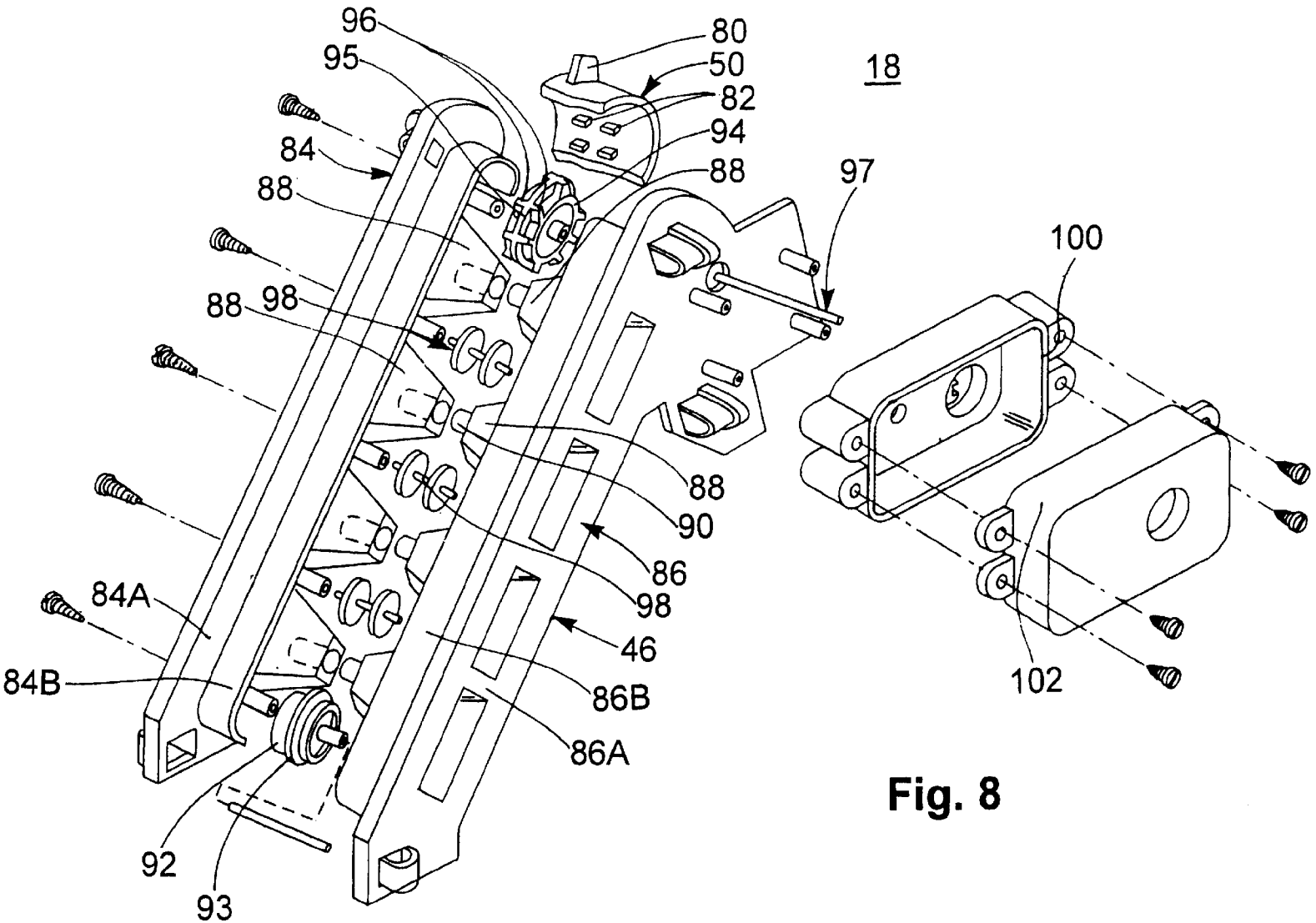
FIG. 8 is an exploded view of the conveyor/gear box assembly.

Referring now to FIG. 8, there shown an exemplary construction of the conveyor 18. Conveyor 18 includes a toy tank tread-type endless belt 50 having regularly spaced, outwardly protruding teeth 80 and regular spaced, inwardly projecting, side by side pairs of inner teeth 82. The conveyor frame 46 is provided by a first conveyor side 84 and a substantially mirror image second conveyor side 86. Each side 84, 86 includes a retaining wall "A" supporting an inwardly projecting belt guide "B", which also serves as part of the track surface supporting the toy vehicles being guided up the conveyor 18. Each side 84, 86 includes a plurality of inwardly projecting, truncated triangular support guides 88. Pins 90 projecting from the guides 88 of the one side 86 are received in openings in the other support guides to hold the sides 84, 86 together. A pulley wheel 92 with a raised center ring 93 is provided at the lower end of the conveyor. The ring at 93 extends into the space between the pairs of inner teeth 82 on the belt 50. A drive gear 94 with a circumstantially raised center ring 95 and transverse, raised teeth 96 to pass between teeth 82 and to engage teeth 82, respectively, is provided on a drive axle 97 at the upper end of the conveyor. Several rollers 98 are provided between the pairs of the support guides 88. The drive axle 97 is extended through the vertical wall of the conveyor side 86 and into a drive housing including a base 100 and cover 102. The drive housing is configured to preferably support and retain a prime mover and the other drive train components which operate the conveyor 18 and tilting roadway 16.

Figure 9:
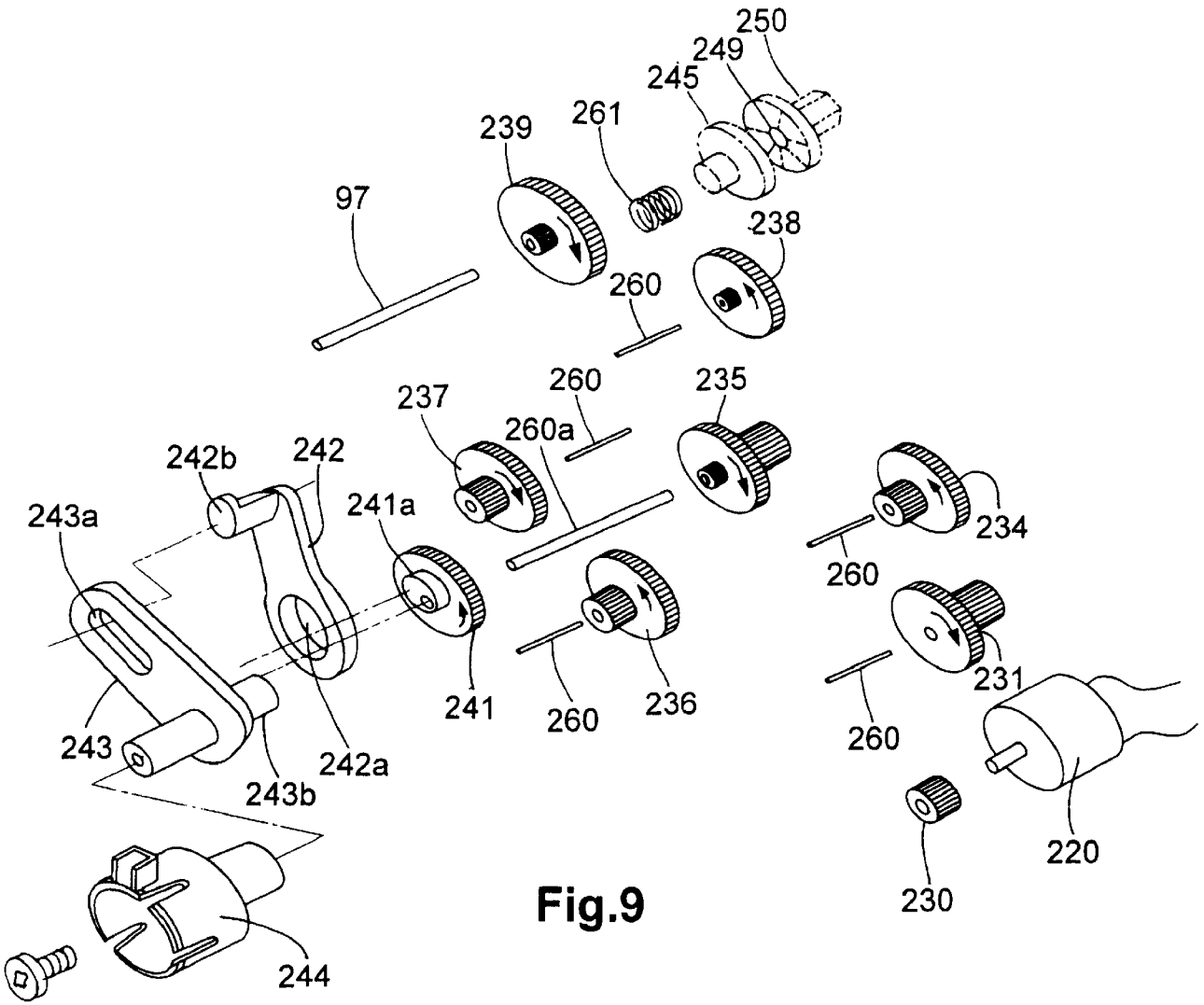
FIG. 9 is an exploded view of the gear box components.

The components of one possible exemplary drive are depicted in FIG. 9. An electric motor 220 or other suitable prime mover drives a pinion 230, which engages the larger gear of a compound gear 231 mounted on a jack shaft 260. The smaller gear of compound gear 231 drives the larger gear of a second compound gear 234 also riding on a jack shaft 260. The smaller gear of compound gear 234 drives the larger gear of a third compound gear 235. Compound gear 235 includes two smaller gears on either side of the larger gear. One smaller gear drives an idler 238 which in turn drives a conveyor gear 239. Conveyor gear 239 can be fixed to conveyor drive axle 97 which in turn can be fixed to the drive gear 94 making a solid connection between the motor 220 and the conveyor 18. However, if desired, a clutch can be interposed between the conveyor gear 239 and the conveyor drive gear 194 for safety. Rotation can be passed from the conveyor gear 239 through a clutch spring 261 pressing against a first clutch member 245, which frictionally or slightly interferingly engages a second clutch member 249. Second clutch member 249 can have a polygonal drive shaft 250 which would key into a similar recess provided in the conveyor drive gear 94. The second small gear on the other side of compound gear 235 can engage and drive the larger gear of yet another compound gear 236, the smaller gear of which drives yet another compound gear 237, a smaller gear of which drives an eccentric gear 241. Gears 235 and 241 can be supported on the same longer jack shaft 260*a*. Shaft 260*a* passes through the center of the eccentric gear 241. The eccentric gear 241 supports a cam in the form of an off centered cylinder 241*a*, which is received in the circular opening 242*a* of an eccentric arm 242. The distal end of the arm 242 supports a connector 242*b* which is received in a slot 243*a* of an eccentric link 243. The link 243 is mounted by a circular boss 243*b* into a suitable support inside the gear box so as to be able to rock back and forth as the eccentric arm 242 is pulled up and down by the cam 241*a* on the eccentric gear 241. A clutch member 244 is secured to the eccentric linkage and is designed to key into and engage a bore in the circular boss 16*a* on the bottom side of the tilting roadway sections 16 (see FIG. 3). The clutch member 244 is preferably molded plastic and has fingers that can collapse inwardly to release engagement with the roadway section 16 to prevent damage.

A user can simply drop vehicles onto the track 12 or use the access ramp 28 in a play mode. The track 12 extends in a generally downward direction from the upper end 18*b* and tilting roadway section 16 to the lower end 18*a* of the conveyor 18 so the vehicles on the track 12 are gravity fed to the lower end of the conveyor 18 where they are engaged and lifted by the conveyor 18 to the upper end 18*b* at the top of the tower 14. The conveyor 18 deposits each raised vehicle onto the top of the ramp 54 in the tower 14, which directs the vehicles by gravity onto the tilting roadway 16.

The tilting roadway 16 rocks back and forth through a predetermined range, for example about 30 degrees up and down with respect to a horizontal plane, to align the distal end of either lane with the upper end of each of the two branches 20, 22. The drive may be geared in such a way that the tilting roadway 16 completes one complete cycle approximately every second while the conveyor moves at a speed of about three to six inches per second. The tilting roadway 16 randomly directs toy vehicles onto one of the two branches 20, 22. While the vehicles travel along a branch, the user may move the portion 62 of the retaining wall or open the door 66 in one branch 20 or drop the roadway panels 72, 74 in the other branch 22 to selectively cause one or more vehicles to leave the track. Vehicles which traverse either branch 20, 22 are directed by the merge portion 24 to the connection portion 26 and back to the lower end 18B of the conveyor 18 where they will be raised by the conveyor 18 for transit again through the loop 12.

If desired, lighting effects can be added to the system with or without sound effects. Also, the various hazards of retaining wall portion 62, door 66 and panels 72, 74 can be configured to be actuated and reset automatically, either at the branches or remotely by the user, or configured to operate automatically, in a predetermined or random fashion using a timing control with such automatic actuators. Also, a portion the outer retaining wall along the single lane connection portion 26 can be provided with an exit ramp and a moveable gate or guard which user can use to close or provide access to the ramp. The device can be powered by other motors including, but not limited to, spring motors, gas engines and fluid turbines. While a belt has been described as the conveying element of the conveyor, other conveying elements including lines, chains or an endless screw can be used to convey unpowered toy vehicles up to the top of the conveyor.

U.S. Provisional Patent Application No. 60/267,554 filed Feb. 9, 2001 is incorporated by reference herein in its entirety.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An unpowered toy vehicle play set including a closed loop track comprising:

a conveyor having a lower end and an upper end, a motor and a conveying element driven by the motor and configured to engage unpowered toy vehicles at the lower end and raise the engaged toy vehicles to the upper end;

at least one tilting roadway along a portion of the closed loop track extending from the upper end towards the lower end of the conveyor, the tilting roadway being mounted to tilt laterally side to side generally transversely to a direction of the closed loop track along the tilting roadway; and at least two track branches leading away and down from the at least one tilting roadway towards the lower end of the conveyor, the at least one tilting roadway being sufficiently proximal to the two track branches to direct unpowered toy vehicles coasting across the tilting roadway onto either of the at least two track branches.

2. The unpowered toy vehicle play set of claim 1 wherein the tilting roadway includes a longitudinally extending upright divider proximal an end of the tilting roadway distal to the upper end of the conveyor to divide the outlet end into two lanes, each lane being generally aligned with a separate one of the two track branches.

3. The unpowered toy vehicle play set of claim 1 wherein the closed loop track further comprises a merge portion coupled with a lower end of each of the at least two track branches to bring the at least two track branches together before reaching the lower end of the conveyor.

4. The unpowered toy vehicle play set of claim 1 wherein the motor is also coupled to the tilting roadway to tilt the tilting roadway side to side.

5. The unpowered toy vehicle play set of claim 1 wherein at least one of the track branches includes a hazard designed to allow a vehicle in the track branch to leave the closed loop track.

6. The unpowered toy vehicle play set of claim 4 wherein the at least one track branch includes a vehicle supporting roadway portion and at least one retaining wall extending along at least part of a lateral side of the roadway portion and wherein at least part of at least one of the roadway portion and the one retaining wall is movable with respect to adjoining remainder of the one track branch to provide an opening to allow an unpowered toy vehicle coasting along the one track branch to leave the closed loop track.

7. The unpowered toy vehicle play set of claim 5 wherein each of at least two track branches include a portion movable with respect to an adjoining remainder of the track branch to allow an unpowered toy vehicle coasting along the track branch to leave the closed loop track.

8. The unpowered toy vehicle play set of claim 5 wherein at least the one track branch includes both a portion of the retaining wall and a portion of the track surface movable with respect to adjoining remainders of the one track branch to allow an unpowered toy vehicle coasting along the one track branch to leave the closed loop track through either movable portion.

* * * * *